US011297913B2

(12) United States Patent
Wang et al.

(10) Patent No.: US 11,297,913 B2
(45) Date of Patent: Apr. 12, 2022

(54) SUNSHADE UMBRELLA WITH HAND-HELD PORTABLE ROTATABLE BASE MECHANISM

(71) Applicant: Linhai Meiyang Parasol Industry Co., Ltd, Zhejiang (CN)

(72) Inventors: Yingying Wang, Zhejiang (CN); Yuefu Ke, Zhejiang (CN); Xuliang Wang, Zhejiang (CN)

(73) Assignee: Linhai Meiyang Parasol Industry Co., Ltd, Zhejiang (CN)

( * ) Notice: Subject to any disclaimer, the term of this patent is extended or adjusted under 35 U.S.C. 154(b) by 0 days.

(21) Appl. No.: 16/934,029

(22) Filed: Jul. 21, 2020

(65) Prior Publication Data

US 2020/0345114 A1 Nov. 5, 2020

(30) Foreign Application Priority Data

Jun. 3, 2020 (CN) ..... 202010495280.3

(51) Int. Cl.
*A45B 23/00* (2006.01)

(52) U.S. Cl.
CPC ..... *A45B 23/00* (2013.01); *A45B 2023/0006* (2013.01); *A45B 2023/0012* (2013.01); *A45B 2023/0043* (2013.01); *A45B 2023/0075* (2013.01)

(58) Field of Classification Search
CPC ..... A45B 2023/0075; A45B 2017/005; A45B 23/00
USPC ..... 248/521
See application file for complete search history.

(56) References Cited

U.S. PATENT DOCUMENTS 6,488,254 B2 * 12/2002 Li ..... A45B 17/00 135/15.1
6,511,033 B2 * 1/2003 Li ..... A45B 23/00 248/519
7,392,816 B2 * 7/2008 Porter ..... A45B 23/00 135/117
7,431,259 B2 * 10/2008 Tung ..... A45B 17/00 135/20.3
7,836,902 B2 * 11/2010 Tung ..... A45B 23/00 135/20.3
8,402,981 B2 * 3/2013 Liu ..... A45B 19/04 135/20.3
8,672,287 B2 * 3/2014 Li ..... E04H 12/2246 248/519
8,807,513 B2 * 8/2014 Volin ..... A45B 17/00 248/521
8,851,093 B2 * 10/2014 Li ..... F16M 13/02 135/16

* cited by examiner

*Primary Examiner* — Noah Chandler Hawk
(74) *Attorney, Agent, or Firm* — JCIPRNET

(57) ABSTRACT

A sunshade umbrella with a hand-held portable rotatable base mechanism includes a base assembly, a support assembly arranged on the base assembly and a canopy assembly arranged on the support assembly. The base assembly includes an upper base plate and a lower base plate which are disposed in a center of the base assembly, and are fixedly fitted up and down. The support assembly includes a support column and a support tube. The support column is insertedly and fixedly connected to the upper and lower base plates, and the support tube is rotatably sleeved outside the support column.

9 Claims, 8 Drawing Sheets

SUNSHADE UMBRELLA WITH HAND-HELD PORTABLE ROTATABLE BASE MECHANISM

CROSS-REFERENCE TO RELATED APPLICATION

This application claims the priority benefit of China application serial no. 202010495280.3, filed on Jun. 3, 2020. The entirety of the above-mentioned patent application is hereby incorporated by reference herein and made a part of this specification.

BACKGROUND

Technical Field

The disclosure belongs to the field of outdoor gears, and in particular relates to a sunshade umbrella with a hand-held portable rotatable base mechanism.

Description of Related Art

The sunshade umbrella is a common outdoor gear, which comprises a base, a support rod and a canopy. For convenience, some sunshade umbrellas on the market are equipped with a support rod rotation feature, that is, the support rod can rotate with the canopy relative to the base. The problems in the prior art are that the support rod and the canopy have a large volume and weight, which can cause the base to be unstable during rotation. The resistance during rotation is relatively large while the support rod is shaking, which causes the user to be strenuous when performing the rotation operation, thus affecting the operation experience.

SUMMARY

In order to overcome the defects in the prior art, the disclosure provides a sunshade umbrella with a hand-held portable rotatable base mechanism.

The sunshade umbrella with the hand-held portable rotatable base mechanism comprises a base assembly, a support assembly arranged on the base assembly and a canopy assembly arranged on the support assembly. The base assembly comprises an upper base plate and a lower base plate which are disposed in a center of the base assembly and are fixedly fitted up and down. The support assembly comprises a support column and a support tube, the support column is insertedly and fixedly connected to the upper and lower base plates, and the support tube is rotatably sleeved outside the support column.

The sunshade umbrella with the hand-held portable rotatable base mechanism. The base assembly further comprises a plurality of support legs around the base assembly, an inner end of each of the support legs is fixedly fitted between the upper and lower base plates; and a lower side of the upper base plate and an upper side of the lower base plate are provided with grooves engaged with the corresponding support legs.

In an embodiment of the invention, an upper center hole edge of the upper base plate for insertedly fitting the support column is bent downward to form an upper extension section, a lower center hole edge of the lower base plate for insertedly fitting the support column is bent upward to form a lower extension section, and the support column is insertedly fitted and fixedly connected to the upper extension section and the lower extension section, respectively.

In an embodiment of the invention, the support assembly further comprises a bottom tube bearing seat arranged between the upper base plate and the support tube and rotatably sleeved outside the support column.

In an embodiment of the invention, a first positioning block is arranged on the bottom tube bearing seat, a bottom portion of the support tube is insertedly fitted outside the first positioning block, and the first positioning block is drivingly fitted with the support tube.

In an embodiment of the invention, a positioning edge is provided on a periphery of the bottom tube bearing seat, and a positioning groove is formed between the positioning edge and the first positioning block, and the bottom portion of the support tube is insertedly fitted into the positioning groove.

In an embodiment of the invention, a second positioning block is rotatably disposed on an upper end of the support column, the second positioning block is disposed in the support tube, and is drivingly fitted to the support tube.

In an embodiment of the invention, the support assembly further comprises a rotation locking mechanism. The rotation locking mechanism comprises a wrench that is rotatably fitted to a side of the bottom tube bearing seat, a locking ring that is fixedly sleeved to the support column, and a positioning pin fitted and connected with the wrench. A plurality of locking grooves are surroundingly arranged on the locking ring, and the positioning pins are insertedly fit with a corresponding one of the locking grooves.

In an embodiment of the invention, the locking ring is clamped between the upper base plate and the bottom pipe bearing seat, and a seal retaining ring is sleeved outside of the locking ring.

In an embodiment of the invention, the canopy assembly comprises a skeleton and a canopy arranged on the skeleton.

Compared with the prior art, the disclosure has a reasonable design and a compact structure, and the structural stability of the disclosure is improved by fixing the support column and two base plates simultaneously, which improves the bearing capacity of the base. The wrench is operated by hands, such that the umbrella can rotate easily, with the characteristics of ultra-lightweight and rotation, and the central column is not easy to shake when the support assembly rotates.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
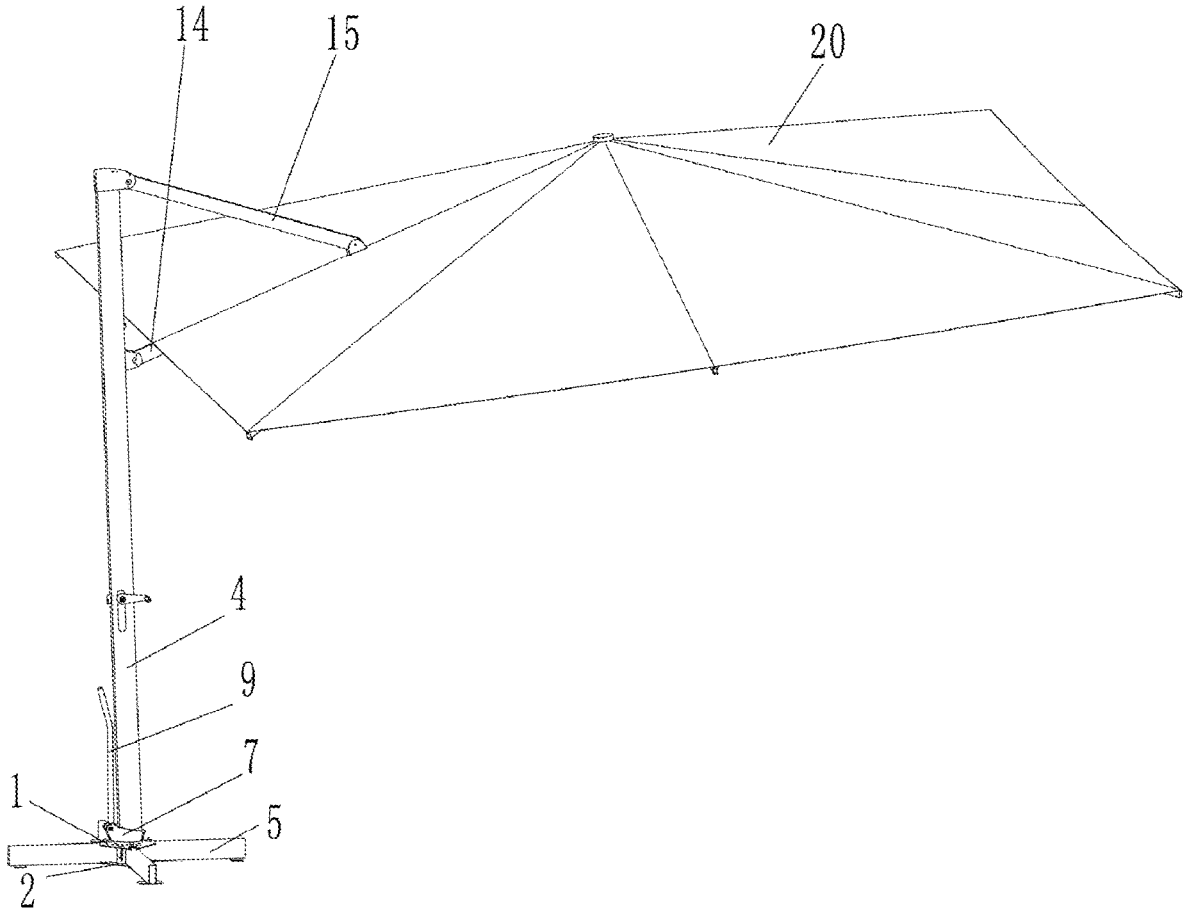
FIG. 1 is a schematic structural view of the present invention.
Figure 2:
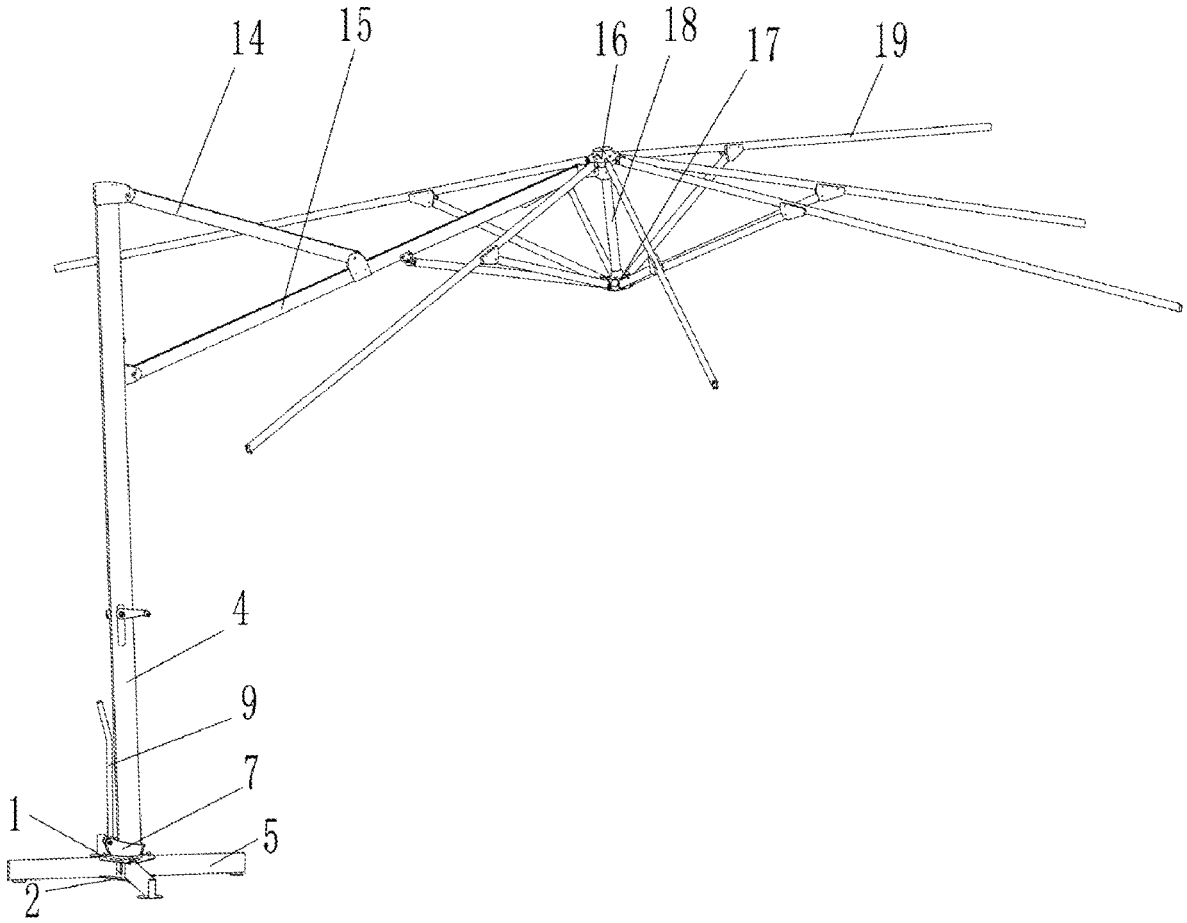
FIG. 2 is a schematic structural view of the present invention when a canopy is removed.
Figure 3:
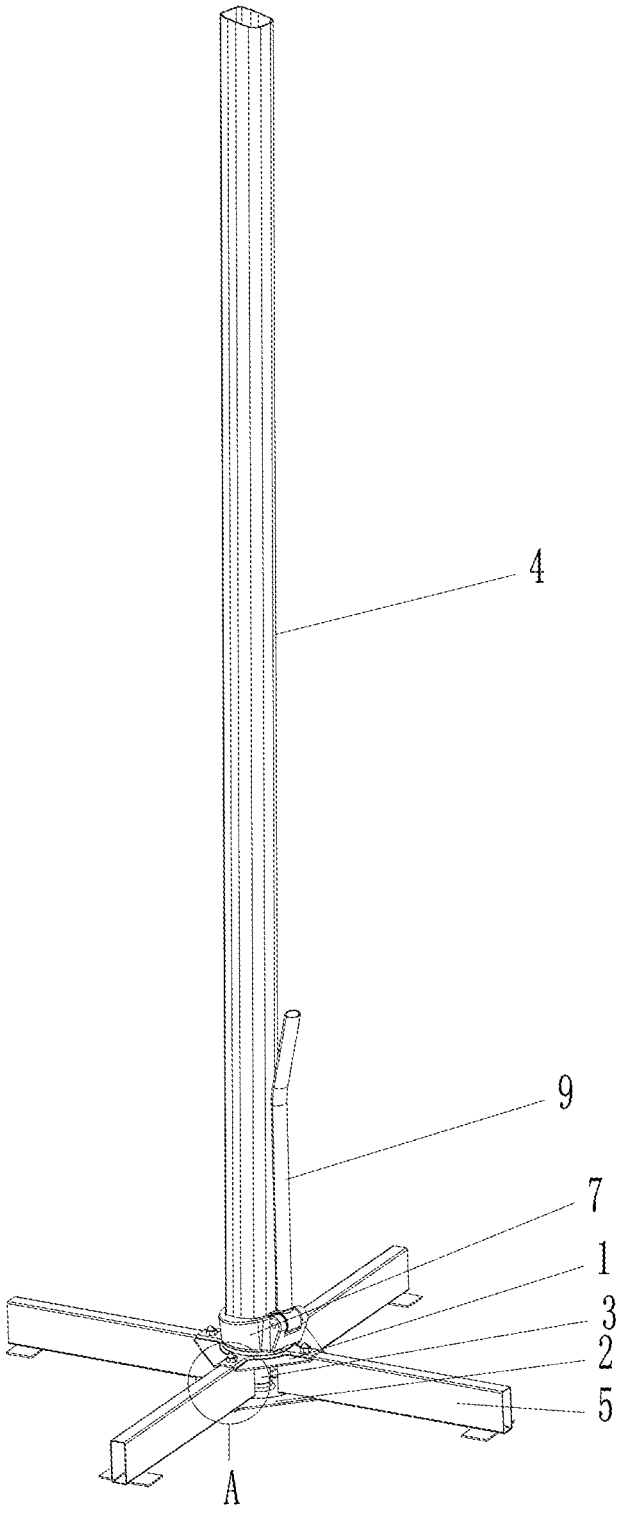
FIG. 3 is a schematic structural view of the present invention when a canopy assembly is removed.
Figure 4:
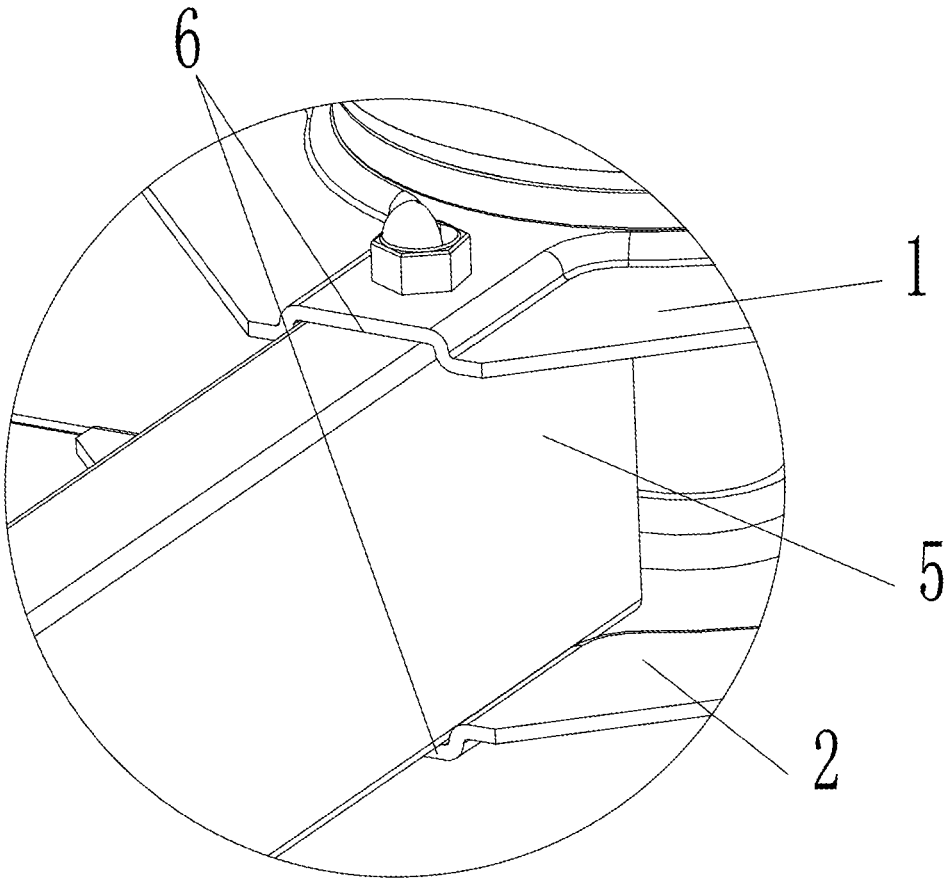
FIG. 4 is an enlarged view at area A in FIG. 3.
Figure 5:
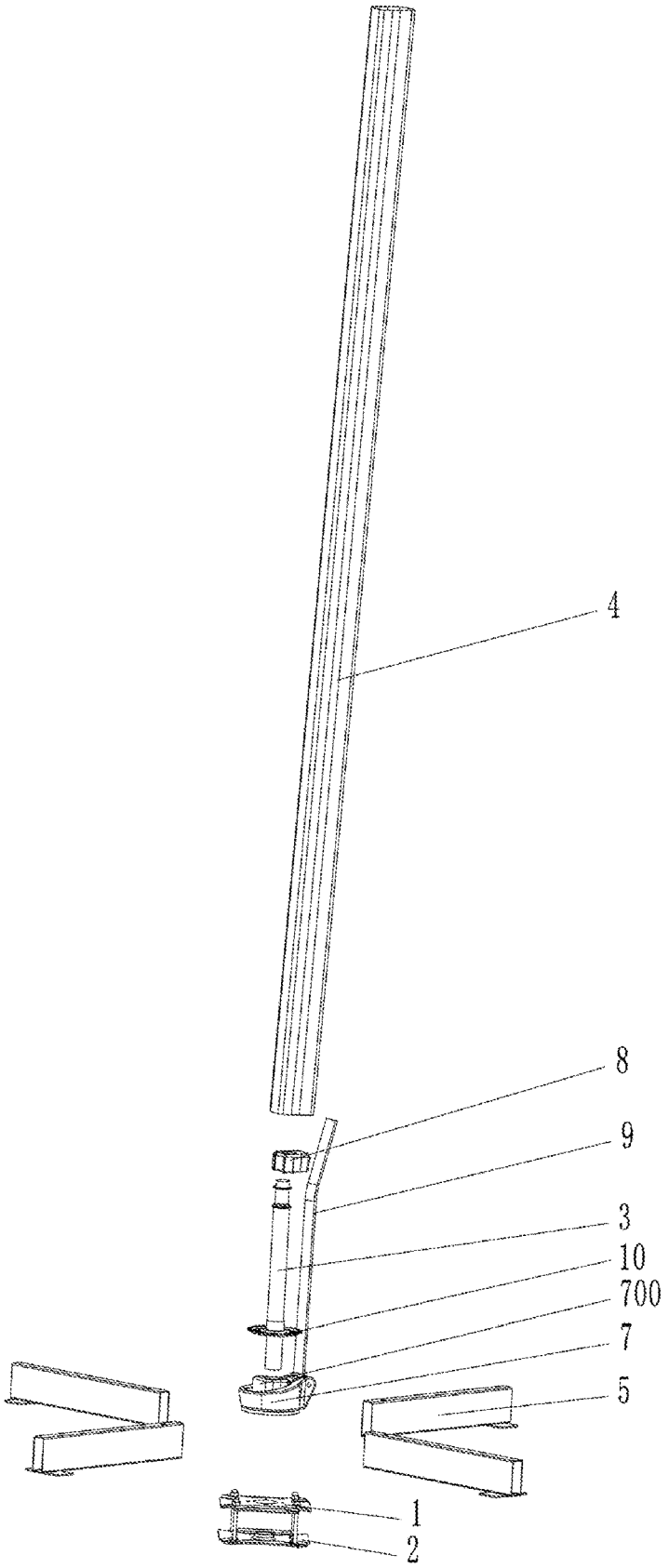
FIG. 5 is an exploded schematic structural view of the present invention when the canopy assembly is removed.
Figure 6:
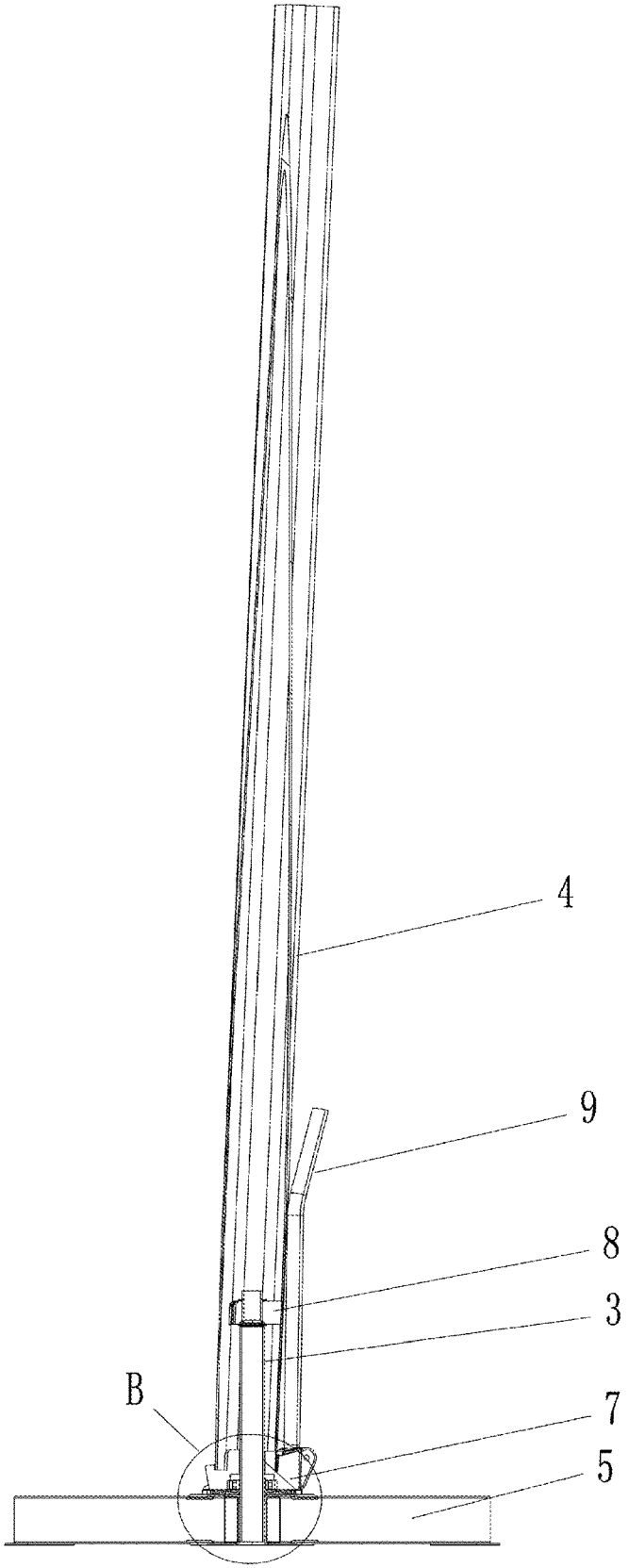
FIG. 6 is an internal schematic structural view of the present invention when the canopy assembly is removed.
Figure 7:
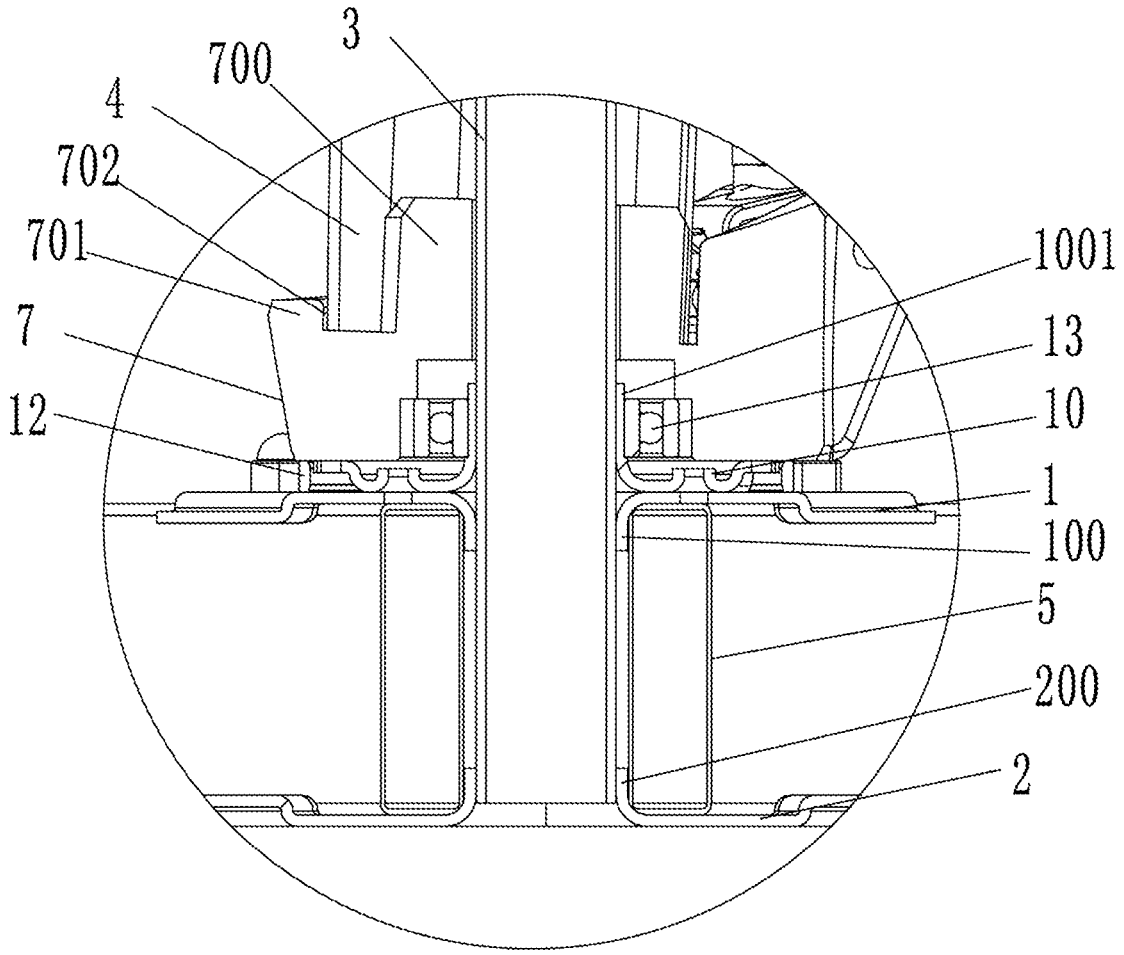
FIG. 7 is an enlarged view at area B in FIG. 6.
Figure 8:
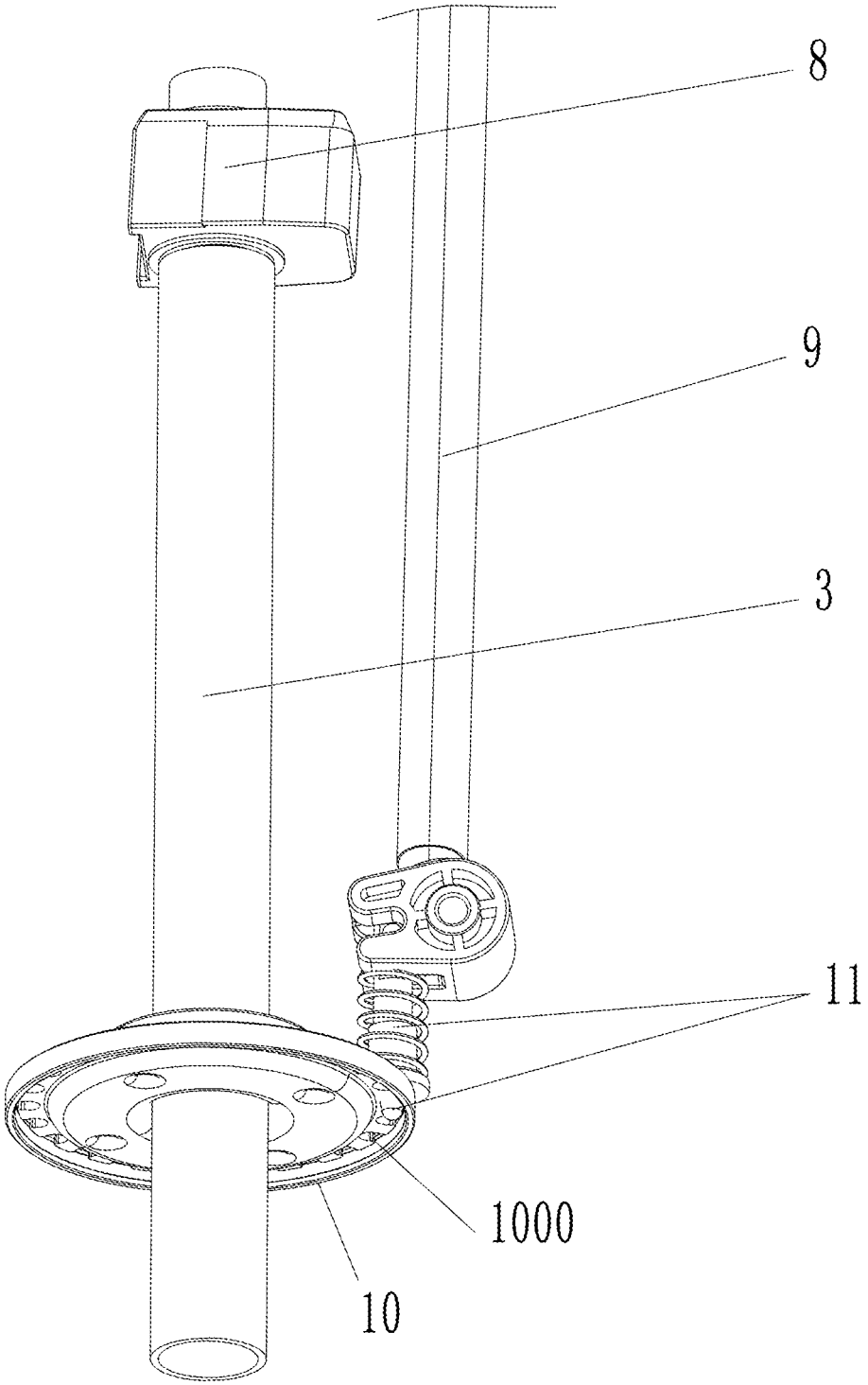
FIG. 8 is a schematic structural view of the connection between a locking ring and a wrench in the present invention.

The present invention will be further elaborated hereafter in connection with the drawings.

As shown in Figures, a sunshade umbrella with a hand-held portable rotatable base mechanism comprises a base assembly, a support assembly arranged on the base assembly and a canopy assembly arranged on the support assembly. The base assembly comprises an upper base plate 1 and a lower base plate 2 which are disposed in a center of the base assembly and are fixedly fitted up and down. The support assembly comprises a support column 3 and a support tube 4, the support column 3 is insertedly and fixedly connected to the upper and lower base plates, and the support tube 4 is rotatably sleeved outside the support column 3.

In addition two base plates, the base assembly further comprises four support legs 5 around the base assembly. The four support legs 5 form an X-shaped structure, and an inner end of each of the support legs 5 is fixedly fitted between the upper and lower base plates by bolts. Both a lower side of the upper base plate 1 and an upper side of the lower base plate 2 are provided with grooves 5 engaged with the corresponding support legs 5. Further, an upper center hole edge of the upper base plate 1 used for insertedly fitting the support column 3 is bent downward to form an upper extension section 100, a lower center hole edge of the lower base plate 2 used for insertedly fitting the support column 3 is bent upward to form a lower extension section 200, and the support column 3 is insertedly fitted and fixedly connected to the upper extension section 100 and the lower extension section 200, respectively. The grooves 6, the upper extension section 100 and the lower extension section 200 are all formed by stamping and bending. The arrangement of the grooves 6 can make the connections between the base plates and the support legs 5 more stable, and the arrangement of the upper extension section 100 and the lower extension section 200 can make the connections between the base plates and the support column 3 more stable, so as to further improve the stability of the present invention and make the support assembly is not easy to shake when rotating.

The support assembly further comprises a bottom tube bearing seat 7 arranged between the upper base plate 1 and the support tube 4 and rotatably sleeved outside the support column 3 by a bearing 13. A first positioning block 700 is arranged on the bottom tube bearing seat 7, a bottom portion of the support tube 4 is insertedly fitted outside the first positioning block 700, a cross-section of the first positioning block 700 and a cross-section of the support tube 4 are both rectangular, and the first positioning block 700 is drivingly fitted with the support tube 4 with corresponding shapes. In particular, a positioning edge 701 is provided on a periphery of the bottom tube bearing seat 7, and a positioning groove 702 is formed between the positioning edge 701 and the first positioning block 700, and the bottom portion of the support tube 4 is insertedly fitted into the positioning groove 702.

An upper end of the support column 3 is rotatably fitted with a second positioning block 8 which is disposed in the support tube 4. A cross-section of the second positioning block 8 and the cross-section of the support tube 4 are both rectangular, and the second positioning block 8 is drivingly fitted to the support tube 4.

The support assembly further comprises a rotation locking mechanism. The rotation locking mechanism comprises a wrench 9 that is rotatably fitted to a side of the bottom tube bearing seat 7, a locking ring 10 that is fixedly sleeved to the support column 3, and a positioning pin 11 fitted and connected with the wrench 9. A plurality of locking grooves 1000 are surroundingly arranged on the locking ring 10. The positioning pin 11 is used for insertedly fitting with a corresponding one of the locking grooves 1000. The positioning pin 11 is connected to a lower end of the wrench 9 through a peg and is pressed with a spring.

The locking ring 10 is clamped between the upper base plate 1 and the bottom pipe bearing seat 7, and a seal retaining ring 12 is sleeved outside of the locking ring 10. A central hole edge of the locking ring 10 used to insertedly fit the support column 3 is bent upward to form a locking ring extension section 1001. The locking ring extension section 1001 is tightly fitted outside the support column 3, and the bearing 13 is interposed between the locking ring extension section 1001 and the bottom tube bearing seat 7.

The canopy assembly comprises a skeleton and a canopy 20. The skeleton includes an upper top seat 16, a lower top seat 17, an umbrella bone rotatably connected to the upper top seat 16 and the lower top seat 17 respectively, a first diagonal rod 14 and a second diagonal rod 15. There are multiple groups of the umbrella bones, and the canopy 20 is arranged on the umbrella bone. One end of the first diagonal rode 14 is hinged to a middle portion of the second diagonal rode 15, and the other end of the first diagonal rode 14 is hinged to a top portion of the support tube 4. One end of the second diagonal rode 15 is hinged to the upper top seat 16, and the other end of the second diagonal rode 15 is hinged to a sliding seat that is slidingly fitted to the support tube 4. The support tube 4 is also provided with a hand-cranked sheave. The hand-cranked sheave is connected to the sliding seat through a rope to drive the sliding seat to move up and down, thereby driving the canopy to expand or collapse. The structure and principle of the canopy assembly together with the sliding seat and the hand-cranked sheave are well-known technologies and have been widely used in the field of sunshade umbrellas.

When rotating, the support tube 4 rotates on the support column 3 through the upper and lower positioning blocks and the bottom tube bearing seat 7, and its rotation is more stable. When locking is required, the wrench 9 is pulled, and the wrench 9 drives the positioning pin 11 to be inserted into one of the locking grooves 1000 of the locking ring 10, such that the bottom tube bearing seat 7 and the support tube 4 cannot be rotated around the support column 3 anymore.

According to the invention, it makes a special design on the connections between the support column 3 and the base assembly. 1) The support column 6 of the general sunshade umbrella is only fixed to the upper base plate 1 and will not be inserted till the end or fixed to the lower base plate 2; however, the support column 6 disclosed in present application is inserted till the end, and is fixed with the two bottom plates at the same time, such that the connections between the support column 6 and the base plates are more stable. 2) The two base plates of the present invention are provided with grooves that engaged with the corresponding support legs 5 to enable the connections between the base plates and the support legs 5 are more compact and stronger. The above two points of the design can ensure that the support assembly is not easy to shake when rotating.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A sunshade umbrella with a hand-held portable rotatable base mechanism, the sunshade umbrella comprising a base assembly, a support assembly arranged on the base assembly and a canopy assembly arranged on the support assembly, wherein the base assembly comprises an upper base plate and a lower base plate which are disposed in a center of the base assembly and are fixedly fitted up and down; and the support assembly comprises a support column and a support tube, the support column is insertedly and fixedly connected to the upper and lower base plates, and the support tube is rotatably sleeved outside the support column, wherein the base assembly further comprises a plurality of support legs around the base assembly, an inner end of each of the support legs is fixedly fitted between the upper and lower base plates; and a lower side of the upper base plate and an upper side of the lower base plate are provided with grooves engaged with the corresponding support legs.

2. The sunshade umbrella with the hand-held portable rotatable base mechanism according to claim 1, wherein an upper center hole edge of the upper base plate for insertedly fitting the support column is bent downward to form an upper extension section, a lower center hole edge of the lower base plate for insertedly fitting the support column is bent upward to form a lower extension section, and the support column is insertedly fitted and fixedly connected to the upper extension section and the lower extension section, respectively.

3. The sunshade umbrella with the hand-held portable rotatable base mechanism according to claim 1, wherein the support assembly further comprises a bottom tube bearing seat arranged between the upper base plate and the support tube and rotatably sleeved outside the support column.

4. The sunshade umbrella with the hand-held portable rotatable base mechanism according to claim 3, wherein a first positioning block is arranged on the bottom tube bearing seat, a bottom portion of the support tube is insertedly fitted outside the first positioning block, and the first positioning block is drivingly fitted with the support tube.

5. The sunshade umbrella with the hand-held portable rotatable base mechanism according to claim 4, wherein a positioning edge is provided on a periphery of the bottom tube bearing seat, and a positioning groove is formed between the positioning edge and the first positioning block, and the bottom portion of the support tube is insertedly fitted into the positioning groove.

6. The sunshade umbrella with the hand-held portable rotatable base mechanism according to claim 3, wherein a second positioning block is rotatably disposed on an upper end of the support column, the second positioning block is disposed in the support tube, and is drivingly fitted to the support tube.

7. The sunshade umbrella with the hand-held portable rotatable base mechanism according to claim 3, wherein the support assembly further comprises a rotation locking mechanism, the rotation locking mechanism comprises a wrench that is rotatably fitted to a side of the bottom tube bearing seat, a locking ring that is fixedly sleeved to the support column, and a positioning pin fitted and connected with the wrench, a plurality of locking grooves are surroundingly arranged on the locking ring, and the positioning pin are insertedly fitted with a corresponding one of the locking grooves.

8. The sunshade umbrella with the hand-held portable rotatable base mechanism according to claim 7, wherein the locking ring is clamped between the upper base plate and the bottom pipe bearing seat, and a seal retaining ring is sleeved outside of the locking ring.

9. The sunshade umbrella with the hand-held portable rotatable base mechanism according to claim 1, wherein the canopy assembly comprises a skeleton and a canopy arranged on the skeleton.

* * * * *